United States Patent [19]

Spencer

[11] 4,441,989

[45] Apr. 10, 1984

[54] PROCESS AND APPARATUS FOR THERMAL CRACKING AND FRACTIONATION OF HYDROCARBONS

[76] Inventor: Peter Spencer, 9 Links Close, Ashtead, Surrey, England

[21] Appl. No.: 422,040

[22] Filed: Sep. 23, 1982

[30] Foreign Application Priority Data

Nov. 3, 1981 [GB] United Kingdom ..... 8133060

[51] Int. Cl.[3] ..... C10G 51/04; C10G 55/04

[52] U.S. Cl. ..... 208/76; 208/72; 208/92; 208/106

[58] Field of Search ..... 208/72, 126, 92, 76, 208/48 Q, 106, 48 R, 93

[56] References Cited

U.S. PATENT DOCUMENTS

| | | | |
|---|---|---|---|
| 2,243,291 | 5/1941 | Seguy | 208/76 |
| 2,395,081 | 2/1946 | Williamson et al. | 208/48 R |
| 2,495,613 | 1/1950 | Tuttle | 208/126 |
| 2,507,523 | 5/1950 | Houdry | 208/92 |
| 3,234,118 | 2/1966 | Chen | 208/93 |
| 3,413,211 | 11/1968 | Becraft et al. | 208/93 |

*Primary Examiner*—Delbert E. Gantz
*Assistant Examiner*—Lance Johnson
*Attorney, Agent, or Firm*—Price, Heneveld, Huizenga and Cooper

[57] ABSTRACT

A method and apparatus for the thermal cracking and fractionation of petroleum heavy gas oil and simultaneously heavy crude oil feedstock below atmospheric pressure. The feedstock is fed to a fractionator after heat exchange with distillate fractions withdrawn from the fractionator. A heavy gas oil fraction is withdrawn from the fractionator, fed to a heater and subsequently to the top of a thermal cracking reactor, while the reduced or heavy crude stock is fed to the mid-section of the reactor. The cracked products are quenched with the feedstock and fed to the bottom flash zone of the fractionator. The process may also be applied to existing crude oil topping still with modifications and operated above atmospheric pressure.

13 Claims, 2 Drawing Figures

PROCESS AND APPARATUS FOR THERMAL CRACKING AND FRACTIONATION OF HYDROCARBONS

BACKGROUND OF THE INVENTION

The present invention relates to the thermal cracking and fractionation of hydrocarbons particularly a reduced petroleum crude oil.

The present approach to visbreaking, which is a mild form of thermal cracking as applied to reduced crude or vacuum residue is to pass the stock to be cracked through a heater essentially in the liquid phase where it is elevated in temperature to about 500° C. From there it is fed to a flash fractionator which operates under a small positive pressure of about 2.0 atmospheres, and here, the liquid and vapour phases separate. The vapour phase is then further separated into lighter distillate fractions.

In some well established process solutions, the separated liquid phase from the flash fractionator is further processed in a second flash fractionator which operates under partial vacuum conditions. Here, heavy gas oil is flashed off and recovered as a product or recycled and subjected to more severe thermal working conditions to produce additional lighter distillate products by passing the heavy gas oil through a second heater then a cracking reactor that is essentially free of internals and commonly referred to as a coking or soaking drum.

The fluid passing through the cracking reactor normally flows upwards, and enters essentially in the liquid phase, but leaves in a mixed liquid-vapour phase, depositing coke in the reactor which accumulates as a solid mass. The coke is subsequently removed by cutting it out in lumps and discharging it through a bottom port.

One of the restrictive features of this process solution of visbreaking is that certain large complex molecules, especially the asphaltenes contained in the heavier fractions, have a greater tendency to cause coke deposition in the heater tubes. This results in reduced thermal efficiency and progressive restrictive fluid flow as well as limiting the practical levels of thermal cracking severity.

Another undesirable feature in the case of more severe thermal cracking is that coke removed from the reactor contains substantial quantities of entrained heavy oils and tars in the interstices of the coke mass.

SUMMARY OF THE INVENTION

It is an object of the present invention to alleviate these difficulties and provide a more efficient process.

It is a further object of the invention to provide such a process in which the yield of the more valuable fractions is higher.

According to one aspect of the present invention there is provided a process for the thermal cracking and fractionation of a heavy gas oil and petroleum crude oil feedstock in which the feedstock is fed to a fractionation column, light fractions are withdrawn from the column, a heavy gas oil fraction is withdrawn from the column and fed to a heater, the heated heavy gas oil and bottoms from the column are fed to a reactor where thermal cracking takes place then the cracked vapour products are fed from the reactor to the column together with the feedstock, the cracked vapour products being quenched by the feedstock and the cracked liquid products being withdrawn from the bottom of the reactor.

There is thus proposed, a process which may recover heavy gas oil from a reduced or heavy crude oil from which lighter more valuable fractions may be produced using the thermal cracking technique, while simultaneously but separately visbreaking the heavier fractions in the feedstock using only one fractionator, one heater and one reactor. No heavy crude stock need be passed through a heater, thereby reducing fouling and the coke derived from the gas oil cracking is low in volatiles.

The process may be operated at various degrees of thermal cracking severity that is preferably arranged to produce low rates of coke deposition. The process may be particularly suitable in the case of small refiners with limited capital to invest.

Some features can be applied with modifications to existing crude topping stills with some effect, to improve the yield of the lighter distillate fractions.

According to a second aspect of the invention, apparatus for the thermal cracking and fractionation of a reduced petroleum crude oil feedstock comprises a fractionator, a heater and a reactor, the fractionator having an outlet near its bottom leading to the heater, the heater having an outlet leading directly to the reactor, the reactor having an outlet leading to the flash zone of the fractionator, and a feedstock input joining the reactor outlet prior to the fractionator.

Preferably, the feedstock is heat exchanged with distillate fractions withdrawn from the column prior to quenching the cracked products, and heavy crude stock from the bottom of the column is fed to the reactor.

Preferably, the column operates between 0.075 and 0.5 atmospheres, for example between 0.15 and 0.33 atmospheres.

The lighter cracked petroleum fractions may be condensed then withdrawn from the fractionator as a single liquid stream saturated with the lightest vapour fractions at a temperature close to ambient.

The reactor may operate at a pressure below atmospheric and preferably contains two separate beds of inert packing, severe cracking being induced in the top bed and, simultaneously, mild thermal cracking induced in the bottom bed. Preferably, heavy gas oil is thermally cracked in the top bed and heavy crude stock is visbroken in the bottom bed, while heavy gas oil is simultaneously stripped from the heavy crude stock in the bottom bed.

The co-produced thermal tars produced in the top bed may either be withdrawn from the reactor as a product or allowed to pass to the bottom bed and to blend with the heavy crude stock.

It is well known that if heavy gas oil is hydrotreated before being subjected to cracking the product yield may be improved and the sulphur content may be reduced.

A further benefit of the process according to the invention, is that if the recovered heavy gas oil is hydrotreated before being subjected to cracking, the resultant visbroken residue may contain less sulphur due to mass transfer of some desulphurised components in the cracked gas oil to the heavy crude stock and some sulphur bearing components in the heavy crude stock to the cracked gas oil in the bottom bed of the reactor.

The reactor preferably includes two beds of inert packing. The packing preferably comprises individual open geometric pieces which have a high voidage and an extended surface and which can be randomly and regularly charged into the reactor, exposed to thermal cracking conditions then discharged followed by mechanical handling of such magnitude so as to cause the deposited coke to be dislodged without significant fracture or deformation of shape to the packing pieces. The packing may comprise cylinders of a carbon steel or steel alloy, having a diameter of between 100 and 400 mm, a length of between 150 and 300 mm and a wall thickness of 2 to 10 mm. Preferably, the cylinders are made from stainless steel and are 250 mm in diameter, 200 mm long and from 5 to 10 mm thick, and may have elements cut out to reduce their weight and improve the fluid flow characteristics through the packing or assist the dislodgement of deposited coke from the packing.

The invention may be carried into practice in various ways, and two embodiments will now be described by way of example.

DESCRIPTION OF PREFERRED EMBODIMENT

Figure 1:
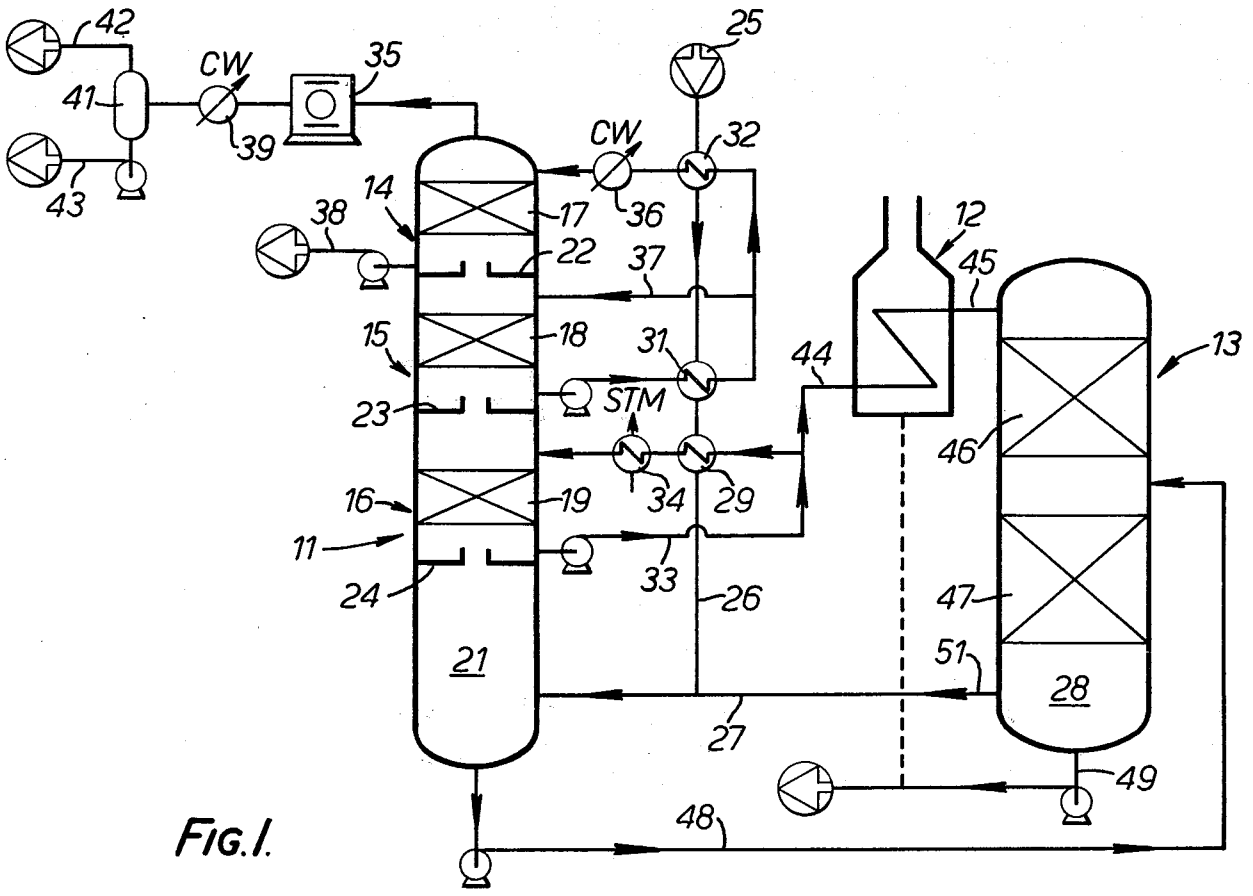
FIG. 1 is a simplified process diagram of a plant in accordance with the invention.

The process employs essentially one fractionator 11, one heater 12 and one reactor 13 as illustrated in FIG. 1.

The fractionator has three sections 14,15,16, and a bottom flash zone 21. Each section is provided with counter-current liquid/vapour contacting internals 17, 18, 19 which may be either trays or packing provided they have low pressure drop characteristic. Below each section is a liquid catch tray 22, 23, 24 to enable all or a portion of the down-flowing liquid to be withdrawn.

The flash zone 21 at the bottom is adequately sized to disengage efficiently particulate coke carried over from the reactor as well as liquid from vapour. The reduced or heavy crude feedstock 25 is introduced into the fractionator via a line 26 which joins a transfer line 27 from the reactor bottom 28 and acts as a quench to cool the cracked vapours from the reactor bottom 28. On its way to the line 27 the feedstock undergoes heat exchange against streams from the fractionator 11 which require to be cooled. Illustrated is the feedstock undergoing heat exchange with recirculating heavy gas oil at 29 and with lighter distillates at 31 and 32 respectively.

The combined stream in line 27 enters the bottom zone 21 of the fractionator 11 which operates between 0.075 and 0.5 atmospheres and at such a temperature that cracking has essentially stopped, which is at about 375° C. Under these conditions a portion of the heavy gas oil and lighter fractions in the cracked vapours from the reactor 13 will disengage from the liquid phase and pass up the fractionator 11.

Heavy gas oil is condensed and recovered in the bottom section 16 by means of a recirculating stream 33 that is externally cooled. Illustrated is cooling by means of heat exchange against feedstock at 29 followed by a steam generator trim 34. For an operating pressure of 0.2 atmospheres the vapour temperature leaving the bottom section 21 would normally be maintained at 275° C.

The function of the fractionator above the bottom section 21 is essentially to condense and remove in liquid solution the maximum amount of light crack distillates from the fractionator 11 as one single stream and so to minimise the quantity of vapour leaving the top of the fractionator thus minimising also the load on the vacuum compressor 35.

The light distillates are condensed by means of a recirculating stream externally cooled against feedstock at 31 and 32 followed by a trim water cooler 36. In between the heat exchangers 31 and 32, a slip stream 37 is taken and passed to the top of the middle section 15 in order to improve the heat exchange efficiency. A product distillate stream 38 is withdrawn from the bottom of the top section 14 as a vapour saturated liquid at about 50° C., close to ambient.

In the event that feedstock is delivered to the process at a high temperature additional external cooling would be required.

The vacuum compressor 35 takes suction at about 0.15 atmospheres and delivers at about 1.175 atmospheres to an after condenser 39 followed by a gas-liquid separator 41 where lightest cracked products are removed from the process at 42 and 43.

Recovered heavy gas oil is withdrawn from the fractionator recirculating stream 33 at about 325° C. and passed via line 44 to the fired heater 12 where the temperature is raised to about 520° C. such that severe thermal cracking occurs in the subsequent reactor 13. The heavy gas oil enters the reactor at the top essentially in the vapour phase, via line 45.

The reactor operates within the pressure range of 0.2 to 1.0 atmospheres and contains two beds of inert packing supported on grids referred to as the top bed 46 and the bottom bed 47, with the fluid flowing downwards.

In the top bed 46 severe thermal cracking of the heavy gas oil occurs producing lighter distillate fractions, thermal tar and coke, whilst in the bottom bed 47 mild thermal cracking of the heavy crude stock occurs, to induce visbreaking. Alternatively, more severe thermal cracking could be encouraged in the bottom bed 47 and less severe cracking in the top bed 46. Heavy crude stock enters the reactor 13 at the top of the bottom bed 47 via line 48 whilst the visbroken residue 49 and cracked vapours 51 leave separately from the bottom 28 of the reactor 13.

The packing in both reactor beds 46, 47 is made up of loose individual pieces having a large voidage with a geometry which is suitable to charge randomly and discharge at regular intervals. They are fabricated from a material which can withstand severe mechanical handling of sufficient severity to dislodge deposited coke as well as the conditions which prevail inside the reactor without significant fracture or deformation of shape. A suitable packing for a reactor 5 meters in diameter by 25 meters high, capable of processing 20,000 barrels per day of reduced crude would be cylinders 250 mm diameter by 200 mm long with a wall thickness of 7.5 mm fabricated from a stainless steel.

The primary function of a cracking reactor is well known, namely to provide a residence time to give the thermal cracking reactions greater opportunity to take place. The packing provided improves the performance in this particular application.

In the top bed 46 the co-produced thermal tars tend to convert into coke if retained in a severe cracking environment. To minimise the formation of coke the thermal tars should be removed as expediently as is practical after they have formed.

The packing provides a surface on which the thermal tars can coalesce whilst the down flowing vapours, assisted by gravity will sweep the tars from the top bed into the bottom bed to mix with the heavy crude stock.

The thermal tar will tend not to convert to coke in the bottom bed 47 due to the milder thermal cracking conditions.

A catch pan (not shown) may be provided below the top bed 46 to collect and withdraw thermal tar as a product.

Some coke however, will inevitably form in the top bed 46. The extended surface of the packing encourages the coke to deposit as dispersed thin layers and so the fluid flow will not be unduly restricted. Since the fluid passing through the packing is essentially vapour the tars settling in the interstices of the coke will be minimised due to the gas stripping effect.

In the bottom bed 47, cracked vapour from the top bed 46 at about 490° C. mixes with incoming heavy crude stock at about 375° C. and flows co-currently down over the packing. The temperature of the mixed fluid is controlled by the ratio of cracked vapour to heavy crude stock so that mild thermal cracking conditions prevail. The temperature is therefore maintained at about 435° C. and the rate of coke deposition on the packing is similar to that at the top bed 46.

In passing through the bottom bed 47 the cracked vapours from the top bed 46 will tend to strip out heavy gas oil from the heavy crude stock at the same time as providing heat to encourage visbreaking.

It is necessary at the end of a cracking cycle to purge the reactors content of lighter volatiles and also to cool the contents before opening the vessel. The packing aids both operations due to the extended coke surface and the access of the stripping and cooling fluids through the respective packing beds. Cracking would normally be discontinued and the packing removed when one of the following conditions became limiting due to accumulated coke.

(a) Pressure drop across either bed 46, 47 causes poor diffusion or distribution of the fluid through the bed.

(b) The net space velocity is too low to effect satisfactory cracking.

(c) Deposited coke begins to integrate with the packing such that it is difficult to cause that packing which has bridged or formed in localised masses to collapse.

Packing would normally be removed by discharging through a bottom port (not shown) when the packing voidage has been displaced by between 20 to 50 percent coke deposition.

The cracking severity should be controlled such that the rate of coke deposition on the packing is preferably in balance in both the beds 46, 47 and averages between 0.5 to 3 weight percent of the reduced crude feedstock.

To provide for continuous operation a second reactor would be required to be used alternately on line.

Based on light Saudi reduced crude the estimated yield, expressed as boiling range fractions, using the described process, that is, severe thermal cracking of the recovered heavy gas oil and visbreaking of the heavier fractions is:

| DISTILLATE FRACTION | YIELD (weight percent) |
|---|---|
| Hydrogen Sulphide | 0.3 |
| Lighter than 100° C. | 8.0 |
| 100 to 185° C. | 11.0 |
| 185 to 345° C. | 34.0 |
| Residue + coke | 46.7 |
| | 100.0 |

Some of the features of the described process may be applied with some effect to existing crude topping stills to improve the overall yield of lighter more valuable distillate fractions. This will now be described with reference to FIG. 2.

Crude oil topping is well established. The basic concept is to heat exchange the feedstock crude oil against those streams which require to be cooled, then before entering the still, which operates between 1.0 to 3.0 atmospheres, the feedstock is passed through a fired heater where the temperature is raised to about 345° C.

Various well known petroleum distillate fractions are withdrawn from the still at appropriate points.

Figure 2:
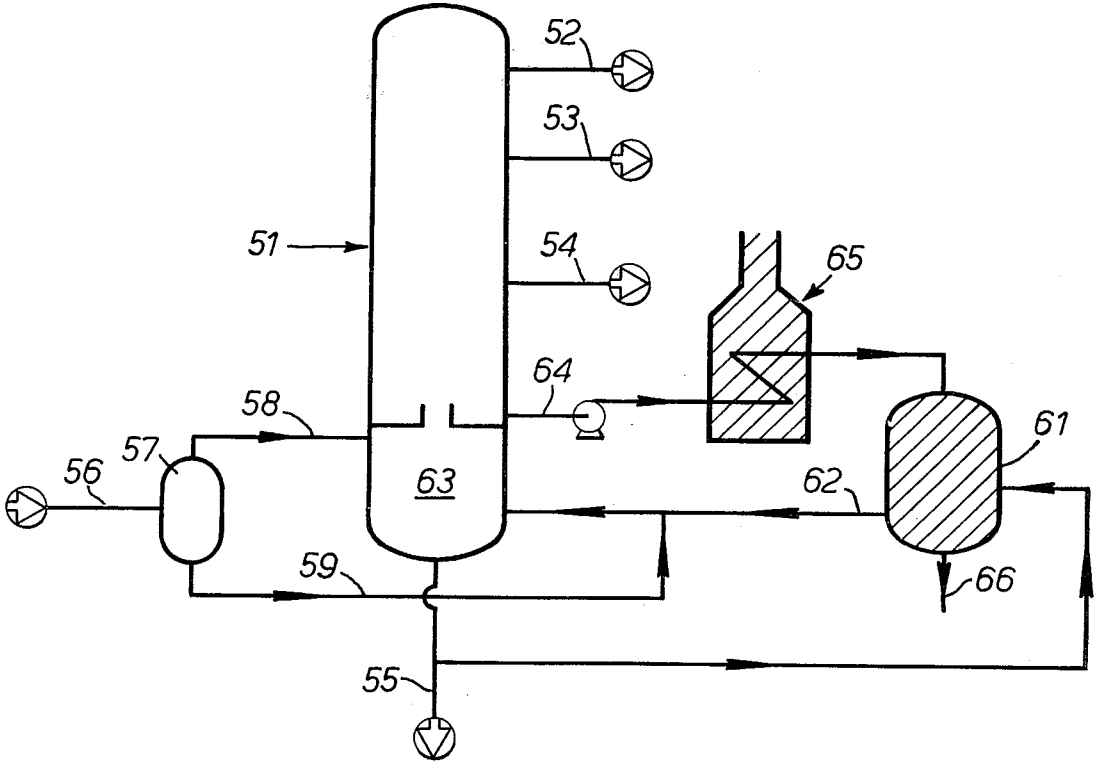
FIG. 2 is a simplified process diagram of an existing plant modified in accordance with the present invention.

FIG. 2 shows a conventional topping still 51 having outlet streams 52, 53, 54, and 55 for naphtha, kerosene, diesel oil and reduced crude respectively. The feedstock 56 is heat exchanged with the distillate fraction streams 52, 53 and 54, though this is not shown in the Figure for the sake of simplicity.

The overall system, however, has been modified so that instead of passing the feedstock, for its final stage of heating, through a fired heater, it is passed to a separator 57 where any separated vapour is passed directly to the still via line 58. The liquid is passed via a transfer line 59 to quench cracked gas oil vapours leaving a reactor 61 via a line 62 before it enters the still 51 so that thermal cracking in the combined stream entering the still 11 has essentially stopped, the resultant temperature being about 345° C.

The heaviest gas oil fraction is withdrawn from the still at 64 immediately above the flash zone 63 of the still 51, passed through a heater 65, raised to thermal cracking temperature, about 500° C., then passed to the top bed of the reactor 61.

A variable proportion of reduced crude 55 from the bottom of still 51 may be passed to the mid-section of the reactor 61 and after mixing with cracked gas oil from the top bed passes down through the bottom bed and leaves in a bottom outlet stream 66 at about 400° C. after being subjected to mild thermal cracking and gas oil stripping.

When applied to light Saudi crude oil an overall increase in the total distillate fractions of between 8 and 20 percent with an equivalent reduction of reduced crude can be achieved, using this modified atmospheric topping process.

Obviously, numerous modifications and variations of the present invention are possible in the light of the above teachings. It is therefore to be understood that withing the scope of the appended claims, the invention may be practiced otherwise than as specifically described herein.

What is claimed as new and desired to be secured by Letters Patent of the United States is:

1. In a process for the thermal cracking of the heavy fraction of a petroleum crude oil feedstock, the steps including:

introducing said feedstock into the flash zone of a fractionator;

withdrawing a bottom stream of heavy fractions from said flash zone and feeding said stream of heavy fractions directly to a reactor;

withdrawing a heavy gas oil fraction from said fractionator;

heating said heavy gas oil;

introducing the heated heavy gas oil into a reactor and heating the stream of heavy bottom fractions to a temperature at which thermal cracking occurs solely by the heat supplied by the heavy gas oil; and thermally cracking said heavy bottom fractions.

2. A process according to claim 1 which further includes withdrawing from the fractionator some cracked vapour products and introducing them into the feedstock prior to introduction of the feedstock into the flash zone thereby quenching said vapour products and heating said feedstock.

3. In a process according to claim 1, the further step of passing the feedstock in heat exchange relationship with lighter fractions from the fractionator.

4. A process for the thermal cracking and fractionation of reduced petroleum crude oil feedstock, employing a thermal cracking reactor, a heater, and a fractionating column comprising a flash zone and a fractionating section, said process comprising:

feeding said feedstock into said flash zone;

removing a bottom stream of heavy fractions from said flash zone and feeding said heavy fractions directly to said reactor;

passing lighter fractions including a heavy gas oil fraction into said fractionating section;

removing from said fractionating section at least one light fraction product stream;

removing from said fractionating section a heavy gas oil stream and feeding said heavy gas oil to said heater and thence to said reactor;

subjecting said heavy fractions and said heavy gas oil to thermal cracking conditions in said reactor;

removing from said reactor a cracked vapour products stream and recycling said cracked vapour products whereby said cracked vapour products are introduced into said feedstream prior to said feedstream being introduced into said flash zone thereby quenching said cracked vapour products and heating said feedstream; and withdrawing from said reactor a cracked liquid products stream.

5. A process according to claim 4 in which said thermal cracking reactor operates at a pressure below atmospheric and contains two separate beds of inert packing, one above the other, the thermal cracking conditions in the top bed being more severe than the thermal cracking conditions in the bottom bed.

6. A process according to claim 5 in which coproduced thermal tars are substantially removed from the said top bed before they have the opportunity to convert further to coke.

7. A process according to claim 6 in which said column and said reactor operate at between 0.15 and 0.33 atmospheres.

8. A process according to claim 7 in which the main source of heat to the process is supplied through recycled heavy gas oil.

9. A process according to claim 8 in which the lighter of said cracked vapour products are condensed in said fractionating section and withdrawn from said fractionation section as a single liquid stream saturated with the lightest vapour fractions at a temperature close to ambient.

10. A process according to claim 9 in which heavy crude stock from the bottom of said column is fed to said reactor.

11. A process according to claim 4 in which said feedstock is heat exchanged with distillate fractions withdrawn from said column prior to quenching said cracked products.

12. A process according to claim 11 in which said feedstock is first separated into a gas stream and a liquid stream, said gas stream being fed directly into said flash zone in said fractionating column and said liquid stream used to quench said cracked vapour products stream.

13. A process according to claim 12 in which said feedstock is first separated into a gas stream and a liquid stream, said gas stream being fed directly into a flash zone in said fractionator and said liquid stream used to quench a hot cracked stream.

* * * * *